US011369240B2

(12) United States Patent
McClendon

(10) Patent No.: US 11,369,240 B2
(45) Date of Patent: Jun. 28, 2022

(54) URINE EVAPORATION DEVICE FOR EVAPORATING EVAPORATIVE INGREDIENTS FROM URINE

(71) Applicant: Lance McClendon, Midlothian, TX (US)

(72) Inventor: Lance McClendon, Midlothian, TX (US)

( * ) Notice: Subject to any disclaimer, the term of this patent is extended or adjusted under 35 U.S.C. 154(b) by 649 days.

(21) Appl. No.: 16/322,714

(22) PCT Filed: Aug. 1, 2016

(86) PCT No.: PCT/US2016/044996

§ 371 (c)(1),
(2) Date: Feb. 1, 2019

(87) PCT Pub. No.: WO2018/026350

PCT Pub. Date: Feb. 8, 2018

(65) Prior Publication Data

US 2021/0330145 A1 Oct. 28, 2021

(51) Int. Cl.
*A47K 11/12* (2006.01)

(52) U.S. Cl.
CPC ..... *A47K 11/12* (2013.01)

(58) Field of Classification Search
CPC ..... A47K 11/12
USPC ..... 4/144.1, 449, 301; 600/573; 604/327
See application file for complete search history.

(56) References Cited

U.S. PATENT DOCUMENTS

2008/0028508 A1* 2/2008 Ziegler ..... A47K 11/12 4/484
2019/0194962 A1* 6/2019 McClendon ..... A47K 11/026

FOREIGN PATENT DOCUMENTS

EP 2196124 A1 * 6/2010 ..... C05F 3/04

* cited by examiner

*Primary Examiner* — Lori L Baker
(74) *Attorney, Agent, or Firm* — Sherri Higgins Law, PLLC; Sheri Higgins

(57) ABSTRACT

A urine evaporation device comprises an outer housing; a panel assembly comprising a panel, wherein the panel assembly is contained within the outer housing, and wherein the panel comprises a liquid-absorbent substance; a fluid inlet, wherein urine contacts the panel after flowing through the fluid inlet; and an evaporator, wherein the evaporator causes evaporative ingredients in the urine to evaporate. A method of evaporating evaporative ingredients in urine comprises flowing urine into a fluid inlet of the urine evaporation device; allowing the urine to contact the panel after flowing into the fluid inlet; and causing or allowing the evaporative ingredients in the urine to evaporate.

20 Claims, 5 Drawing Sheets

URINE EVAPORATION DEVICE FOR EVAPORATING EVAPORATIVE INGREDIENTS FROM URINE

TECHNICAL FIELD

Environmentally-friendly waste collection systems can be used to collect human waste, such as urine. Waste collection systems are used in a variety of devices, including portable toilets. A urine collection system can allow the water from the urine to evaporate, thus leaving behind solid portions of the urine.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1:
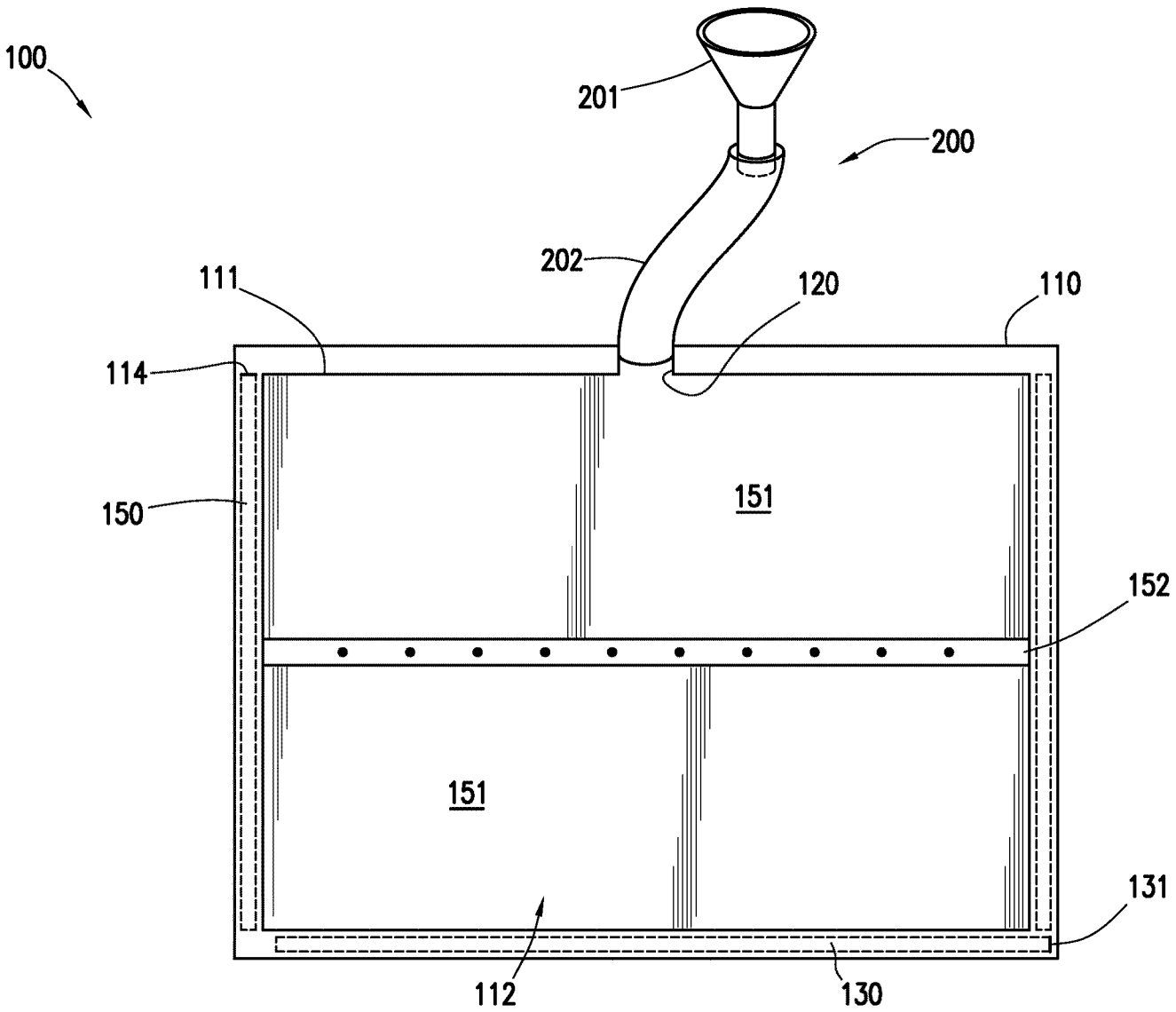
FIG. 1 is a front cross-sectional view of a urine evaporation device according to certain embodiments.

It should be understood that, as used herein, "first," "second," "third," etc., are arbitrarily assigned and are merely intended to differentiate between two or more urine evaporation devices, panels, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

The availability of water for human use can decline due to droughts or other environmental changes as well as depletion of water from water tables, also called aquifers. Reduction of water from aquifers can occur because the water can be used to water crops; provide water for animals, such as cattle; and provide water for human use (e.g., for household use and drinking supplies). These reductions can occur due to drought or when the demand for water exceeds the supply. Water availability declines can have far reaching consequences, affecting many countries and cities worldwide. For example, California commonly experiences droughts lasting for years. Other countries also commonly experience severe droughts, such as Mexico that was recently hit with the lowest rainfall in decades.

In order to combat declining water tables in parts of the world; a push for waterless toilets has erupted. These waterless toilets are designed to reduce the amount of water used in households and businesses; thereby reducing the overall amount of water used by humans in everyday activities. However, these waterless toilets are generally permanent and not easily moved between locations.

Many people and industries do not have easy access to permanent toilets. Examples of people include, but are not limited to, campers, backpackers, hikers, hunters, mountain climbers, ranchers and farmers, natural disaster victims and volunteers, people who drive in a motor vehicle for long time periods—such as salespeople and truck drivers for transportation, and workers—such as road workers and oil and gas extraction workers. Examples of industries include, but are not limited to, transportation, military, natural disaster emergency response personnel, police officers—such as border patrol, utility companies, oil and gas exploration and extraction companies, ranching, and farming.

Such people often rely on portable toilets, when available, to use the bathroom. However, access to a portable toilet is not always possible, or may not be easily accessible. For example, more than about 700 mountain climbers spend almost 2 months on Mount Everest each year without easy access to toilets. It is also estimated that approximately 2.6 billion people worldwide do not have access to suitable sanitation, and instead, leave waste on the ground or in a pit that would otherwise go into a sanitation system for proper processing. By way of another example, for truck drivers in the transportation industry, pulling off a road or highway to use a public toilet is not always easy due to geographic spacing of public toilets and increases the time it takes to arrive at the destination.

For people without access to suitable sanitation such as a permanent or portable toilets, limited solutions exist. Such solutions include urinating and/or defecating on the ground or in a pit, or urinating into a container and then either pouring the urine out onto the ground or into a toilet at a later time. Truck drivers or other people who spend long periods of time in a vehicle also often have to resort to using containers to collect urine and then trying to dispose of the urine at a later time. Even if the urine is later disposed of in a toilet or sink, water is still used to flush or rinse the urine from the toilet or sink, which wastes water and decreases available water supplies. Additionally, urinating and/or defecating on the ground pose several problems to the environment, including people and animals. Human waste in outdoor environments is becoming an increasing health risk to humans and animals. Outdoor urination and defecation can contaminate natural water sources, such as rivers, streams, and lakes; thereby spreading disease to humans and animals. Moreover, disease can be spread by people and animals when walking through urine-soaked ground and translocate the urine to other soil and/or water sources.

Attempts have been made to provide sanitation receptacles that can more easily be used to collect urine. However, these attempts have at least one disadvantage because of the inability to provide a user-friendly and portable means for collecting urine.

It has been discovered that a urine evaporation device can be used to collect and store urine. The evaporation device can allow evaporative ingredients, such as the water portion of urine, to evaporate; thus, leaving behind solid portions of the urine after the water evaporates. The urine evaporation device can include a liquid-absorbent substance that holds the urine. The liquid-absorbent substance can include a biodegradable or biocompatible substance that can be shredded or ground up into smaller pieces or pellets after evaporation of the water. The smaller pieces or pellets can be used as fertilizer for plants or disposed of in a proper facility.

Some of the advantages of the urine evaporation device include, but are not limited to: the absorbent substance can be used for multiple days before reaching the end of its absorbency capacity; the absorbent substance can be safely disposed of after use; and the device can be portable, thereby allowing people an easy and effective way to safely urinate without contaminating nearby water sources and spreading disease.

As used herein, "biocompatible" means the quality of not having toxic or injurious effects on biological systems. Biodegradability refers to tests, which allow prolonged exposure of the test substance to microorganisms. As used herein, a substance with a biodegradation rate of >20% is regarded as "inherently primary biodegradable." A substance with a biodegradation rate of >70% is regarded as "inherently ultimate biodegradable." A substance passes the biodegradability test if the substance is regarded as either inherently primary biodegradable or inherently ultimate biodegradable.

According to certain embodiments, a urine evaporation device comprises: an outer housing; a panel assembly comprising a panel, wherein the panel assembly is contained within the outer housing, and wherein the panel comprises a liquid-absorbent substance; a fluid inlet, wherein urine contacts the panel after flowing through the fluid inlet; and an evaporator, wherein the evaporator causes evaporative ingredients in the urine to evaporate.

According to other embodiments, a method of evaporating evaporative ingredients in urine comprises: flowing urine into a fluid inlet of a urine evaporation device, wherein the urine evaporation device comprises: an outer housing; and a panel assembly comprising a panel, wherein the panel assembly is contained within the outer housing, and wherein the panel comprises a liquid-absorbent substance; allowing the urine to contact the panel after flowing into the fluid inlet; and causing or allowing the evaporative ingredients in the urine to evaporate.

It is to be understood that the discussion of preferred embodiments regarding the urine evaporation device is intended to apply to the device embodiments and the method embodiments.

Turning to the figures, FIG. 1 is a front schematic view of a urine evaporation device 100 according to certain embodiments. The urine evaporation device 100 includes an outer housing 110. The outer housing 110 has a perimeter 111. The perimeter 111 of the outer housing 110 can include a variety of shapes and dimensions. The perimeter 111 can be a variety of geometric shapes including, but not limited to, square, rectangular, circular, oblong, and conical—defined by a length, width, and depth; a diameter/circumference and depth; and a diameter of the base and height of the apex.

The perimeter 111 of the outer housing 110 can be a variety of dimensions. The dimensions of the perimeter 111 can vary and can be selected based, in part, on the anticipated number of users or total volume of urine expected to enter the urine evaporation device 100. For a square perimeter, the length and height can be in the range of about 6 inches (in.) (15.2 centimeters (cm)) to about 5 feet (ft.) (1.5 m). For a rectangular perimeter, the length can be in the range of about 6 in. (15.2 cm) to about 5 ft. (1.5 m) and the height can be in the range of about 6 in. (15.2 cm) to about 5 ft. (1.5 m). For a circular perimeter, the diameter can be in the range of about 6 in. (15.2 cm) to about 5 ft. (1.5 m). For an oblong perimeter, the longest cross-sectional distance can be in the range of about 6 in. (15.2 cm) to about 5 ft. (1.5 m). For a conical perimeter, the base of the cone can have a diameter in the range of about 5 in. (12.7 cm) to about 4 ft. (1.2 m) and a height of the apex in the range of about 6 in. (15.2 cm) to about 5 ft. (1.5 m). The depth can range from about 1 in. (2.5 cm) to about 5 feet (1.5 meters).

The perimeter 111 of the outer housing 110 can be made of a variety materials. According to certain embodiments, the material is selected to be rigid or semi-rigid. Examples of suitable materials for the outer housing 110 include, but are not limited to, metals, metal alloys, hard plastics, wood, and reinforced celluloses. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal or metal of a metal alloy of the outer housing 110, or any other component of the urine evaporation device 100 that can be made of metal, can be selected from lithium, sodium, potassium, rubidium, cesium, beryllium, calcium, strontium, barium, radium, aluminum, gallium, indium, tin, thallium, lead, bismuth, scandium, titanium, vanadium, chromium, manganese, thorium, iron, cobalt, nickel, copper, zinc, yttrium, zirconium, niobium, molybdenum, ruthenium, rhodium, palladium, praseodymium, silver, cadmium, lanthanum, hafnium, tantalum, tungsten, terbium, rhenium, osmium, iridium, platinum, gold, neodymium, gadolinium, erbium, oxides of any of the foregoing, and any combinations thereof. Preferably, the metal or metal of a metal alloy is selected from the group consisting of lithium, beryllium, calcium, aluminum, tin, bismuth, scandium, chromium, manganese, thorium, nickel, copper, zinc, yttrium, zirconium, praseodymium, silver, cadmium, terbium, neodymium, gadolinium, erbium, oxides of any of the foregoing, and any combinations thereof. According to an embodiment, the metal is neither radioactive nor unstable. A metal alloy can also contain a non-metal. The non-metal can be selected from the group consisting of graphite, carbon, silicon, boron nitride, and combinations thereof.

The wood of the outer housing 110, or any other component of the urine evaporation device 100 that can be made of wood, can be selected from the group consisting of hickory, pecan, beech, birch, walnut, elm, sycamore, alder, aspen, oak, ash, cherry, maple, poplar, cedar, fir, hemlock, pine, redwood, spruce, and combinations thereof. According to certain embodiments, the wood is a hardwood as classified by the Janka Rating System, which measures the relative hardness of woods. According to certain other embodiments, if a soft wood is used, the outer housing 110 further includes a hardwood as a reinforcement for the outer housing 110.

The urine evaporation device 100 includes a panel assembly 150. The panel assembly 150 includes a panel 151. The panel assembly 150 can also include a second, third, fourth, and so on, panels 151. The number of panels 151 and the dimensions of the panels can be selected based in part on the overall dimensions of the perimeter 111 of the outer housing 110 as well as the total volume of urine that is anticipated to flow into the urine evaporation device 100. By way of example, if the total volume of urine is anticipated to be 2 liters (L) per day, then only a first panel 151 may be needed. By way of another example, if the total volume of urine is anticipated to be 50 L per day, then 10 or more panels 151 may be needed. The length of the panel 151 can be in the range from about 5 in. (12.7 cm) to about 50 in. (127.0 cm). The height of the panel 151 can be in the range from about 5 in. (12.7 cm) to about 50 in. (127.0 cm). The depth or thickness of the panel 151 can be in the range from about 1 in. (2.5 cm) to about 30 in. (76.2 cm). The dimensions of the panel 151 can be selected based on the anticipated volume of urine per day. Generally, the larger the volume, the larger the dimensions would be. It should be understood though, that smaller dimensions may be selected as the total number of panels to be included in the panel assembly increases.

The panel assembly 150 can include one or more separators 152 for separating two or more panels 151. As shown in FIG. 1, the separator 152 can include openings or be made from a porous material to allow liquid to flow between the panels 151. According to certain embodiments, the separator 152 is made from a material that imparts some rigidity to the panels 151 and panel assembly 150. Examples of suitable materials for the separator 152 include, but are not limited to, metals, metal alloys, hard plastics, wood, and reinforced celluloses. This rigidity can inhibit or prevent a panel 151 that contains urine from no longer being retained within the panel assembly 150 and the urine evaporation device 100. The separator 152 can have varying dimensions. According to certain embodiments, the length, width, and depth of the separator 152 is greater than or equal to the length, width, and depth of a corresponding panel 151. The height or thickness of the separator 152 can vary and range from about 0.2 in. (0.5 cm) to about 3 in. (7.6 cm). The separator 152 can also have curved sides to form a trough wherein the height is measured from the bottom of the separator to the top of the sides. This embodiment can be useful to retain urine within the separator trough, which can prevent spillage of the urine outside of the panel assembly 150.

The panel assembly 150 can be contained within the outer housing 110. The panel assembly 150 can include sidewalls that facilitate containment within the outer housing 110. The sidewalls can also impart some rigidity to the panel assembly 150; thus, providing a contained unit whereby a panel 151 that contains urine is inhibited or prevented from no longer being retained within the panel assembly 150 and the urine evaporation device 100. Examples of suitable materials for the sidewalls of the panel assembly 150 include, but are not limited to, metals, metal alloys, hard plastics, wood, and reinforced celluloses. According to certain embodiments, the panel assembly can be temporarily contained within the outer housing 110. According to these embodiments, the panel assembly 150 can be inserted into and removed from the outer housing 110. The sidewalls of the panel assembly 150 can facilitate insertion and removal from the outer housing 110. According to other embodiments, the panel assembly 150 is permanently contained within the outer housing 110.

The panel 151 of the panel assembly 150 includes a liquid-absorbent substance. As used herein, the term "liquid-absorbent" means the capacity and tendency to absorb or soak up water-based liquids. Liquid-absorbent substances can also swell as the substance absorbs a liquid. In this instance, the liquid-absorbent substance is also known as a water-swellable substance. The liquid-absorbent substance can be a superabsorbent substance, also known as a superabsorbent material (SAM). A superabsorbent material is generally a hydrophilic polymer that is capable of rapidly absorbing water-based liquids in amounts hundreds or more times its own mass.

A polymer is a large molecule composed of repeating units, typically connected by covalent chemical bonds. A polymer is formed from monomers. During the formation of the polymer, some chemical groups can be lost from each monomer. The piece of the monomer that is incorporated into the polymer is known as the repeating unit or monomer residue. The backbone of the polymer is the continuous link between the monomer residues. The polymer can also contain functional groups connected to the backbone at various locations along the backbone. Polymer nomenclature is generally based upon the type of monomer residues comprising the polymer. A polymer formed from one type of monomer residue is called a homopolymer. A copolymer is formed from two or more different types of monomer residues. The number of repeating units of a polymer is referred to as the chain length of the polymer. The number of repeating units of a polymer can range from approximately 11 to greater than 10,000. The conditions of the polymerization reaction can be adjusted to help control the average number of repeating units (the average chain length) of the polymer.

In a copolymer, the repeating units from each of the monomer residues can be arranged in various manners along the polymer chain. For example, the repeating units can be random, alternating, periodic, or block. As used herein, a "polymer" can include a cross-linked polymer. As used herein, a "cross link" or "cross linking" is a connection between two or more polymer molecules. A cross-link between two or more polymer molecules can be formed by a direct interaction between the polymer molecules, or conventionally, by using a cross-linking agent that reacts with the polymer molecules to link the polymer molecules. A second polymer can also be grafted onto the backbone of a first polymer.

According to certain embodiments, the liquid-absorbent substance of the panel 151 is selected from the group consisting of cellulose and modified cellulose (including cellulose fibers, cotton fibers, plant bark, wood, plant leaves, grass, paper, cardboard, and egg crates), cottonseed hulls, sawdust, wood shavings, and combinations thereof. The cellulose or modified cellulose can be in the form of fibers, pieces, and/or shreds (e.g., shredded paper or pieces of cardboard). Fibers, pieces, and shreds can increase the overall surface area of the liquid-absorbent substance; thereby increasing the absorbing capacity of the liquid-absorbent substance. As used herein, the term "absorbing capacity" means the total volume of a water-based liquid the substance can absorb.

According to certain embodiments, the liquid-absorbent substance of the panel 151 is a superabsorbent material (SAM). The SAM can be selected from the group consisting of a starch-based SAM, a cellulose-based SAM, a synthetic SAM, and combinations thereof. The SAM can also be a superabsorbent polymer. The superabsorbent polymer can include, without limitation, cross-linked sodium polyacrylate, poly-acrylic acid sodium salt, polyacrylamide copolymer, ethylene maleic anhydride copolymer, cross-linked carboxymethylcellulose, polyvinyl alcohol copolymers, cross-linked polyethylene oxide, and starch grafted copolymer of polyacrylonitrile.

According to certain embodiments, the liquid-absorbent substance is a biomass substance. As used herein, the term "biomass" means a substance that can be used as a fertilizer. The panel 151 can wholly or partially include biocompatible and/or biodegradable substances.

The panel 151 can further include other substances. Other substances can include, without limitation, non-absorbent materials and deodorizers. The percentage of the liquid-absorbent substance and other substances can vary. According to certain embodiments, the percentage of the liquid-absorbent substance is at least 50%, preferably at least 70%. In other embodiments, the percentage of the liquid-absorbent substance is selected such that the panel 151 is able to absorb a desired volume of urine.

The substances making up the panel 151 can be consolidated together into a single unit. The substances making up the panel 151 can also be mixed together, pressed, and then optionally coated on the front, back, sides, top, and/or bottom of the panel to form a single unit. The coating can be a permeable material or an impermeable material. For an impermeable coating, preferably, the top and bottom of the panel is not coated to allow urine to penetrate into the panel, and the front and/or back of the panel is also not coated to allow air flow into the panel. The coating can also provide rigidity to the panel 151; thus, providing a contained unit whereby a panel 151 that contains urine is inhibited or prevented from no longer being retained within the panel assembly 150 and the urine evaporation device 100.

Figure 3:
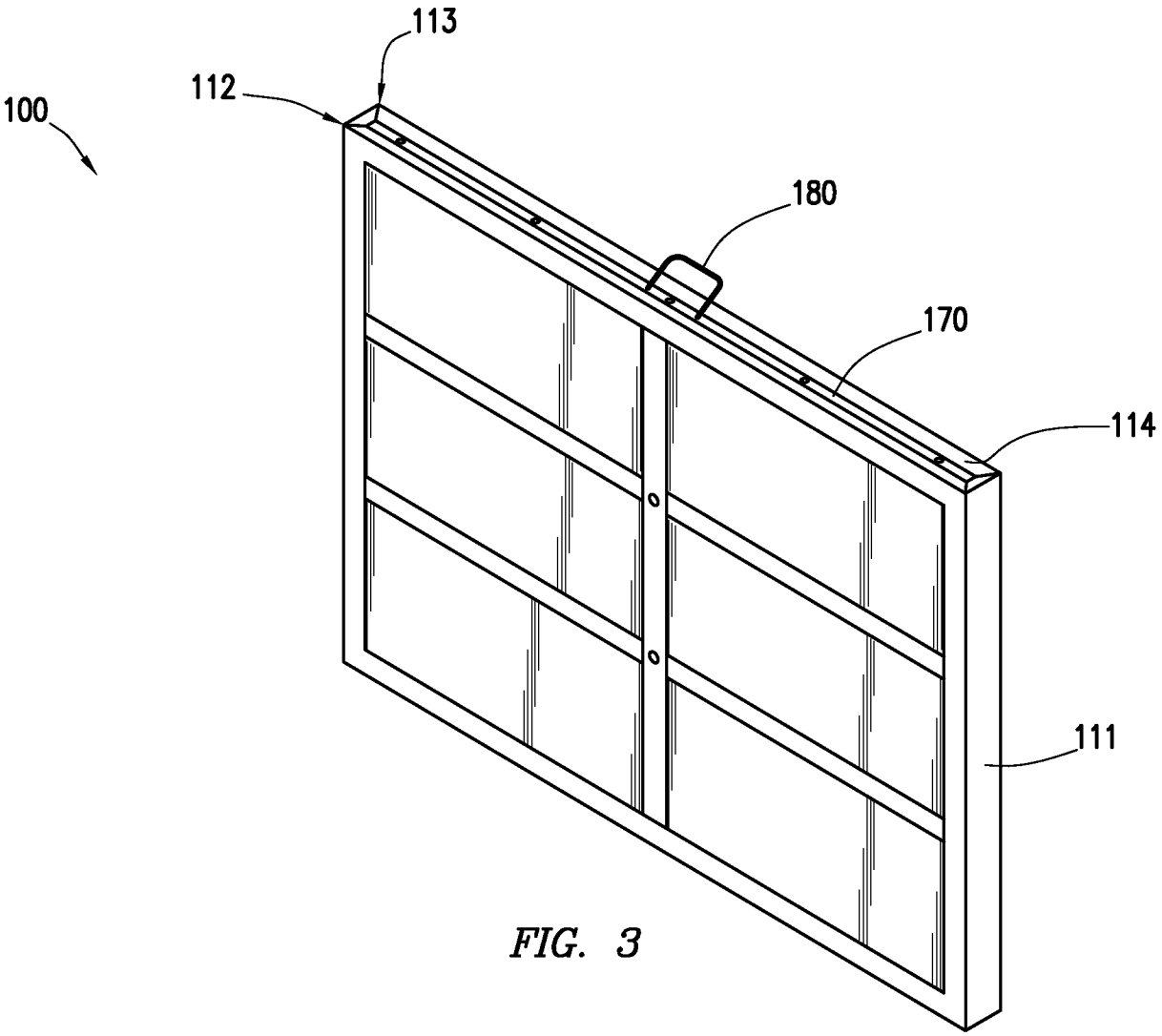
FIG. 3 is a top perspective view of the urine evaporation device of FIG. 2.

The urine evaporation device 100 includes a fluid inlet. As shown in FIG. 1, the fluid inlet 120 can be part of the outer housing 110. As shown in FIG. 3, the fluid inlet 170 can be part of the panel assembly 150. Still referring to FIG. 3, the panel assembly 150 can include a top perimeter. The top perimeter can be made of a variety of materials, including, but not limited to, metals, metal alloys, wood, and plastic. The top perimeter material can include one or more holes or openings in various numbers and spacing arrangements. The one or more holes or openings can be the fluid inlet 170.

Figure 6:
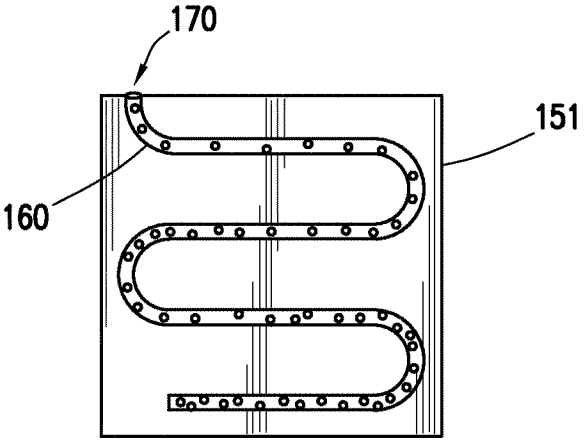
FIG. 6 is a cross-sectional view of a panel of a urine evaporation device according to certain other embodiments.

The urine evaporation device 100 can also include both, fluid inlet 120 and fluid inlet 170. The fluid inlet 120/170 provides a fluid flow path for urine to come in contact with a panel 151 of the panel assembly 150. According to certain embodiments, urine contacts the panel 151 after flowing through the fluid inlet 120/170. The fluid inlet 120 and the one or more holes or openings making up the fluid inlet 170 can include a one-way valve to prevent urine from flowing back into flow tube 202 or out of the urine evaporation device 100. As shown in FIG. 6, the panel 151 can further include a perforated tube 160 located in at least a portion of a panel 151. The perforated tube 160 can be made out of a flexible plastic, for example. The perforated tube 160 can provide a distribution conduit for urine to flow throughout the panel 151. The perforated tube 160 can take any pattern through the panel. As depicted in FIG. 6, the perforated tube 160 is shown as generally S-shaped curves. Urine can flow into the perforated tube 160 via a fluid inlet 120/170. When the panel assembly 150 includes two or more panels 151, each panel's perforated tube 160 can be connected in series or parallel to allow the urine to flow into multiple panels.

Figure 4:
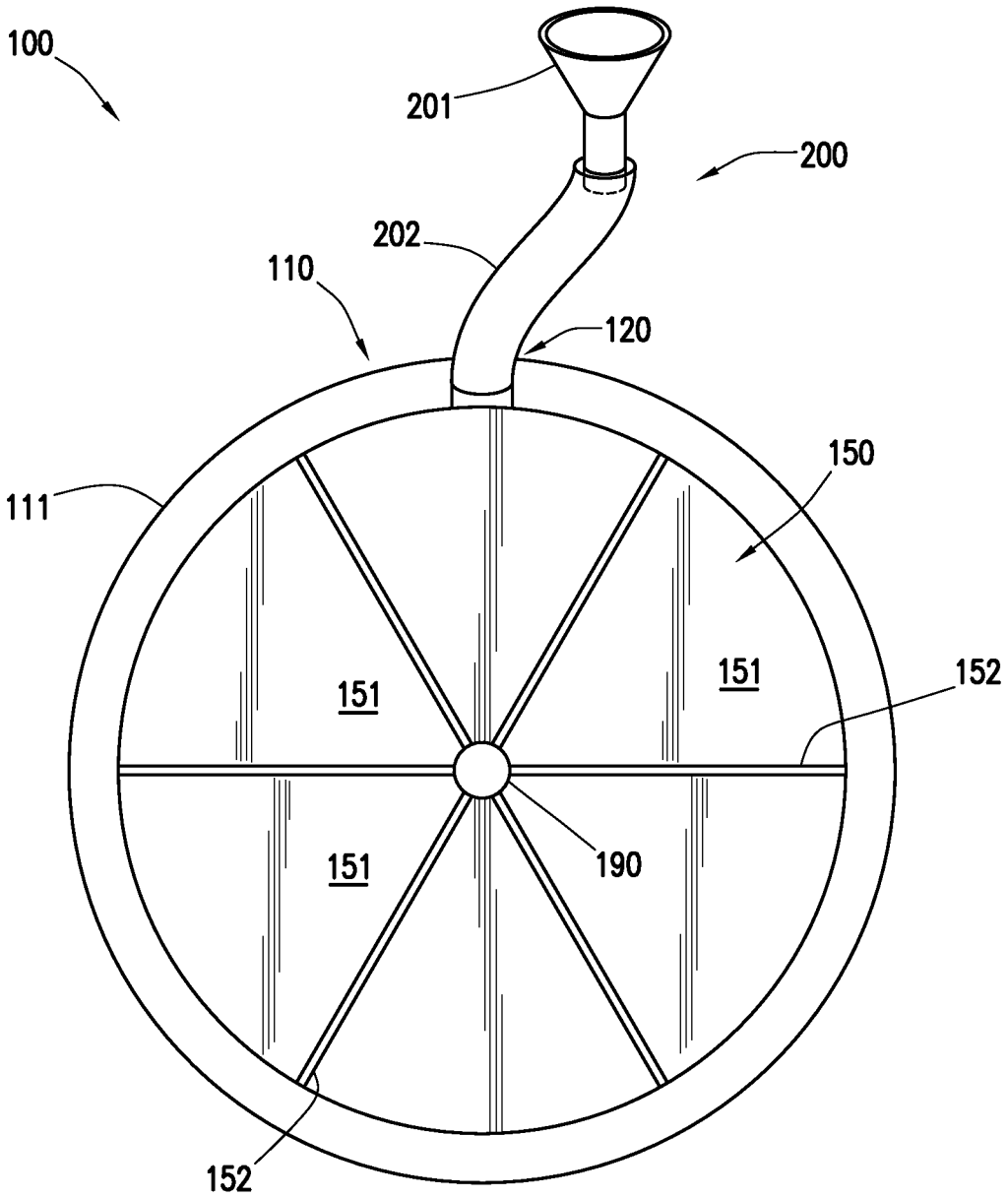
FIG. 4 is a front perspective view of a urine evaporation device according to certain other embodiments.

As shown in FIGS. 1 and 4, the urine evaporation device 100 can further include a channel 200. The channel 200 can include a funnel 201 and a flow tube 202. A first end of the flow tube 202 can be in engagement with a tip of the funnel 201, while a second end of the flow tube can be inserted into fluid inlet 120 or positioned adjacent to fluid inlet 170. The channel 200 can direct urine into the fluid inlet 120/170. Once the urine enters the fluid inlet 120/170, the urine can flow into a panel 151 of the panel assembly 150. The liquid-absorbent substance within the panel 151 can absorb the urine if the liquid-absorbent substance is not fully saturated (i.e., no longer capable of absorbing any more liquid). A user may urinate directly into the funnel 201. These embodiments may be useful for smaller, portable urine evaporation devices 100, such as those used by campers, mountain climbers, people driving for long time periods, ranchers, etc. The diameter of the base of the conical funnel 201 can range from about 2 in. (5.1 cm) to about 10 in. (25.4 cm). The diameter of the base can be adjusted to better accommodate male and female users. For example, the diameter of the base may be smaller for male users compared to female users. The urine evaporation device 100 may also include two or more funnels having different sized base diameters to allow a fast and efficient means to interchange one funnel for another funnel to the flow tube 202 to make use by males and females possible.

Figure 2:
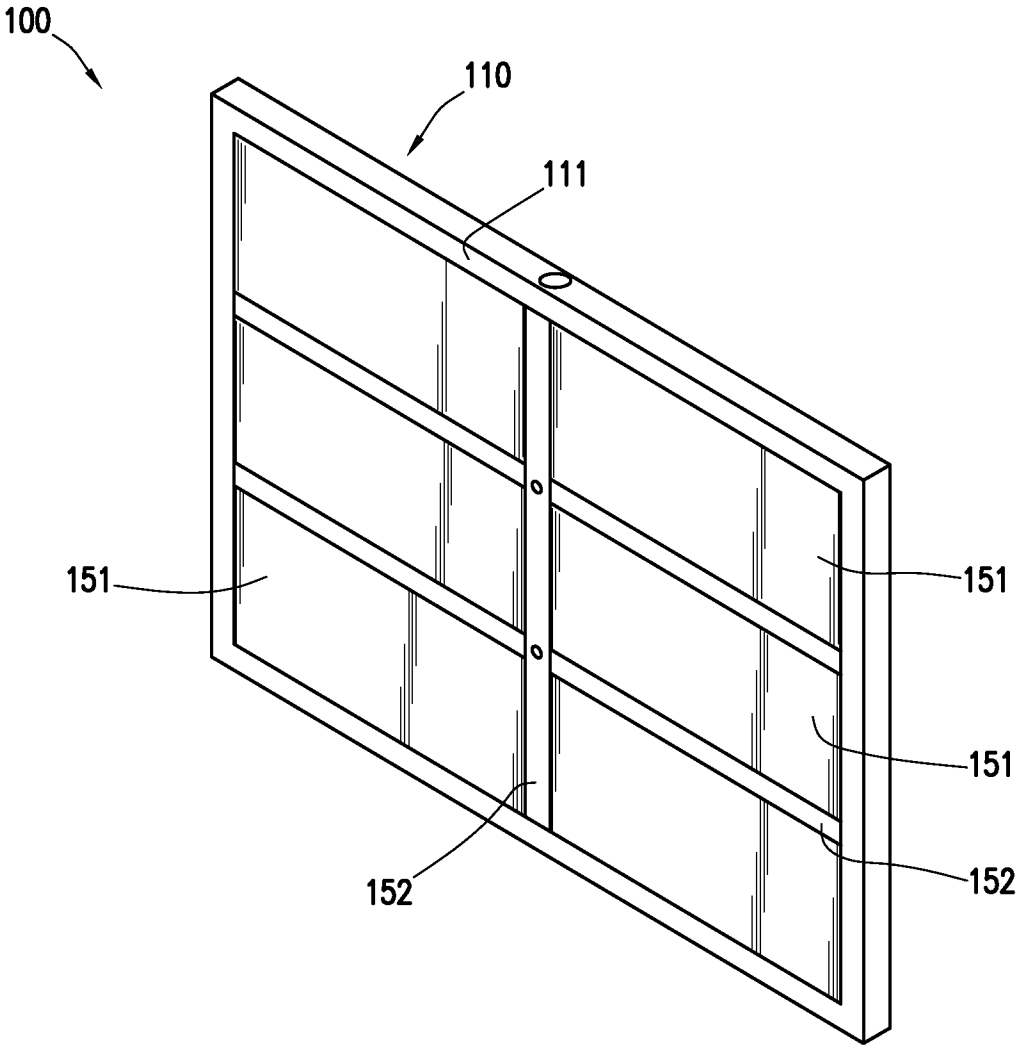
FIG. 2 is a front perspective view of a urine evaporation device according to certain embodiments.

If the panel assembly 150 includes two or more panels 151 and one or more separators 152, urine can flow into adjacent panels via the openings or pores within the separator, wherein the adjacent panels are not fully saturated with urine. By way of example, FIG. 2 shows a urine evaporation device 100 containing six panels 151 in the panel assembly 150 and three separators 152. As depicted in FIG. 2, using the relative terms top, bottom, middle, left, and right as depicted in the drawing, urine can first flow into the top left and right panels via fluid inlet 120/170. When the top left and right panels become fully saturated, urine can then flow into the middle left and right panels via the separators 152, until those panels become fully saturated. Urine can then flow into the bottom left and right panels via the separators 152 until those panels become fully saturated. It should be understood that some urine can flow into downstream panels even though the upstream panels are not fully saturated, for example, due to gravity.

Referring back to FIG. 1, the outer housing 110 can further include a reservoir 130 or secondary containment device and a reservoir port 131. The reservoir 130 can hold excess urine that is not absorbed by the panels 151. The reservoir 130 can be a pan, tube, or trough. The reservoir 130 can be located in various locations of the outer housing 110, for example, along a perimeter edge or the front or back and can be selected based on the intended orientation of the device with respect to gravity (i.e., a longitudinal axis of the reservoir would be perpendicular to gravitational forces) such that the urine does not spill out of the reservoir. A tube reservoir can include an inlet operatively connected to the panel for allowing flow of urine from the panel into the tube reservoir. A flow tube can also be connected to the reservoir 130 and a tank (not shown) for holding excess urine. The reservoir port 131 can include a removable plug (not shown). The excess urine located in the reservoir 130 can be poured out of the reservoir, preferably into a toilet or other suitable receptacle, via removal of the plug in the reservoir port 131. A wick (not shown) can be positioned with one end of the wick located in the reservoir 130 or inlet of a tube reservoir and the other end in connection with a panel 151. The wick can draw urine from the reservoir and into a panel that is not fully saturated.

Referring to FIG. 4, the urine evaporation device 100 can include a circular outer housing 110 and wedge-shaped panels 151. A knob 190 can be part of the panel assembly 150. The knob 190 can be used to rotate the panel assembly 150 in a clockwise or counter clockwise direction relative to the fluid inlet 120. In this manner, once a particular panel 151 becomes fully saturated with urine, the knob 190 can be used to rotate the panel assembly 150 to expose another panel that is not fully saturated with urine. According to this embodiment, the separators 152 do not contain openings or made from a porous material, and are thus, impermeable to the migration of a liquid. It should be understood however, that the separators 152 shown in FIG. 4 can include openings or be made from a porous material, in which case, the knob 190 may not be needed. According to these embodiments, the urine evaporation device 100 can further include a stand (not shown) for keeping the device in an upright position without rolling or falling over. The urine evaporation device 100 can be positioned in the stand during use (i.e., during urine flow into the panel assembly).

The urine evaporation device 100 includes an evaporator. As used herein, the term "evaporator" means a device that causes or allows the evaporation of a water-based liquid (i.e., the liquid undergoes a phase change from a liquid to a gas). The evaporator causes evaporative ingredients in the urine to evaporate. According to certain embodiments, the evaporative ingredient in the urine is water. The evaporator can cause the evaporative ingredients in the urine to evaporate from a panel 151 that is partially or fully saturated with urine. The evaporator allows airflow to contact the panel 151 of the panel assembly 150 to evaporate the evaporative ingredients from urine. After evaporation of the evaporative ingredients in the urine, non-evaporative ingredients, such as minerals, can remain in the panel.

According to certain embodiments, the outer housing 110 includes the evaporator. The front 112 and back 113 of the outer housing 110 can be open (i.e., no material covers the front and back of the outer housing from a front or back perimeter 111 of the outer housing), for example, as shown in FIG. 1. According to other embodiments, the front 112 of the outer housing 110 includes a porous material covering that overlays the panel assembly 150, while the back 113 includes a solid, non-porous material covering. Suitable examples of a porous material include, but are not limited to, a wire mesh screen, a hard plastic screen, and a flexible plastic screen. A porous material covering may be useful to inhibit or prevent saturated panels from no longer being retained within the panel assembly 150 and the urine evaporation device 100. According to certain other embodiments, the front 112 and the back 113 of the outer housing 110 includes the porous material covering.

Figure 5B:
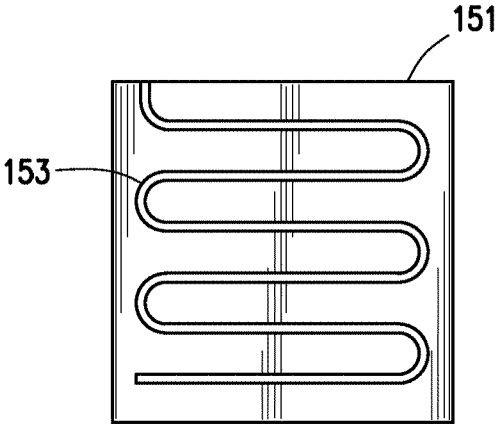
FIGS. 5A and 5B are cross-sectional views of a panel of a urine evaporation device according to certain embodiments.
Figure 5A:
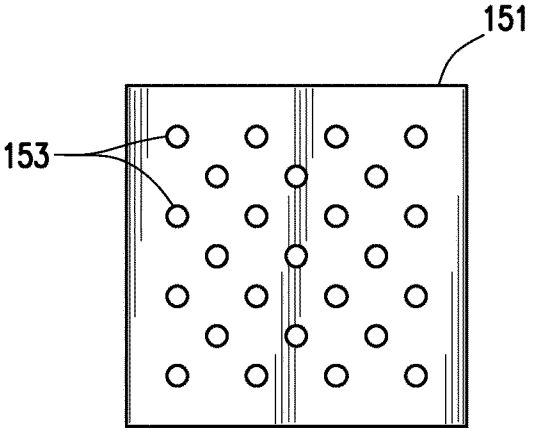

Referring to FIGS. 5A and 5B, the panel 151 can include one or more voids 153 within the panel substances. The voids can work in tandem with the evaporator for increasing the evaporation of the evaporative ingredients in the urine. As shown in FIG. 5A, the voids 153 can be in the form of holes. As shown in FIG. 5B, the void 153 can be in a generally S-shaped form. According to these embodiments, the back 113 of the outer housing 110 can include a solid material covering, while the front 112 of the outer housing can include no covering or a porous material covering due to the increased evaporation provided by the voids 153. It should be understood that the number of voids, the size of the voids, and the location of the voids can be selected based on a desired amount of evaporation needed. For example, in colder climates, it may be useful to increase the number and size of the voids to facilitate increase air flow to the panel. In this manner, the increased air flow can evaporate the evaporative ingredients in the urine at a faster rate compared to another panel having fewer voids or smaller voids. It should also be understood, that every panel of the panel assembly does not need to include voids, the same number of voids, the same size of voids, nor the same location of voids. A variety of combinations will be apparent to those skilled in the art based on the anticipated total volume of urine, the selection of the liquid-absorbent substance, the dimensions and number of panels, and the environmental conditions in which the urine evaporation device 100 will be used, among other things.

There are a variety of factors that can affect the amount of evaporation of the evaporative ingredients in the urine. Such factors include, but are not limited to, the anticipated total volume of urine, the selection and concentration of the liquid-absorbent substance, the dimensions and number of panels, and the environmental conditions, such as temperature and humidity, in which the urine evaporation device will be used. Numerous modifications to the urine evaporation device 100 can be made to provide a desired amount of evaporation. By way of example, the more surface area of the panels that are exposed to air flow, the more evaporation that occurs. According to this example, both the front 112 and back 113 of the outer housing 110 can include a porous material covering or no covering that increases air flow to the panels as opposed to a solid covering on either the front or back. By way of another example, an external fan (not shown) can be used to direct air flow to the panels. This example can be useful when outside temperatures, wind speed, and/or humidity do not provide the desired amount of evaporation. In some cases, it may take 4 hours to 3 days for the evaporative ingredients in the urine to fully evaporate; thus, leaving a completely dry panel 151. A semi-dry or dry panel 151 is then capable of absorbing more urine.

However, the absorbing capacity of the liquid-absorbent substance of the panel 151 decreases over time as the panel absorbs urine, dries out, and absorbs more urine. The liquid-absorbent substance may eventually lose all absorbing capability. The time it takes for the liquid-absorbent substance to lose all absorbing capacity can range from about 1 day to about 1 month. According to certain embodiments, the panel assembly 150 can be removed from the outer housing 110. As can be seen in FIG. 3, the sides of the outer housing 110 can include a groove 114 for receiving the sidewalls of the panel assembly 150. The panel assembly 150 can also include a grip or handle 180. The handle 180 can be used to insert and remove the panel assembly 150 from the outer housing 110. By way of example, to switch out a panel assembly 150, one can grasp the handle 180 and pull upwards on the panel assembly causing the panel assembly to slide out of the outer housing via the grooves of the outer housing and sidewalls of the panel assembly. A second panel assembly 150 can then be inserted into the outer housing 110 by pushing down on the second panel assembly and slide or drop into the outer housing.

After removal of the panel assembly 150 from the outer housing 110, the panel assembly can be properly disposed of, or the panels 151 of the panel assembly can be ground up into smaller pieces or pellet form. The pieces or pellets can be added to soil. The non-evaporative ingredients in the urine (e.g., minerals), which are now part of the used panels, can be beneficial as a fertilizer for plants and gardens, for example.

The following are some examples of possible uses of the urine evaporation device 100. The following examples are for illustrative purposes only and not intended to limit the scope of the various embodiments.

By way of a first example, the urine evaporation device 100 can be portable and able to be carried by a single person. This first example may be useful for mobile people, such as campers, back packers, mountain climbers, military personnel, ranchers, farmers, airplane pilots, and people who drive long distances in a motor vehicle (e.g., semi-truck drivers). According to this example, the urine evaporation device 100 can include a grip or handle 180 for carrying the device. The handle 180 can be part of the panel assembly 150. The outer housing 110 can include 2 hinges that have flanges on the sides of the hinges that can insert into slots in the outer housing at the top of the grooves 114, whereby when in a closed position, a person can carry the device from one location to the next by the handle without the panel assembly becoming removed from the outer housing. The back 113 of the outer housing 110 can include a solid material covering and no covering or a porous covering for the front 112 of the outer housing 110, whereby the device can be laid flat on the back of the outer housing in a seat of a motor vehicle or the ground or a table etc. or positioned as shown in FIGS. 1 and 3. Preferably, the urine evaporation device 100 includes the channel 200. A camper, back packer, or rancher, for example, can carry the device to a desired location, place the device on the ground, urinate into the device 100 via the funnel 201 of the channel 200 wherein the urine is absorbed by the liquid-absorbent substance of the panel 151, and then carry the device to a different location. A semi-truck driver, for example, can place the device 100 in a seat or floorboard of a motor vehicle, utilize the funnel 201 to urinate into the funnel and flow tube, wherein the urine is absorbed by the liquid-absorbent substance of the panel. The number of panels, according to this first example, can range from 1 to about 4—depending on the dimensions of the panels. Preferably, the number of panels and the dimensions of the panels are selected such that the urine evaporation device is easily portable and able to be carried by a single person. The evaporative ingredients in the urine can then evaporate via the evaporator (e.g., no front covering, a porous front covering, and/or voids within the panel substances). In this manner, the device can be used for several days before a new panel assembly would be needed. To switch out the panel assembly, the hinges can be raised, which allows the panel assembly to be removed via the handle and a second panel assembly can be inserted.

By way of a second example, the urine evaporation device 100 can be part of a portable toilet, also known as a Porta-Potty. Portable toilets are commonly used for outdoor events, such as concerts, festivals, weddings, and marathons; construction sites, such as roadway crews, oil and gas workers, electric company workers, and home construction and remodeling workers; public parks; athletic fields; golf courses; and campgrounds. The device can be located inside the portable toilet or outside the portable toilet. Urine from a urinal or urine from a toilet that has been separated from feces can flow into the panel 151 of the panel assembly 150 via one or more flow tubes or conduits. Depending on the anticipated volume of urine: there can be more than one urine evaporation device 100 per portable toilet, wherein the two or more devices can be connected in series or parallel; multiple panels 151 can be used; and/or the panels can have larger dimensions. According to this second example, each urine evaporation device 100 can easily accommodate from 1 to about 3 people for a period of 8 hours before the liquid-absorbent substance of the panels 151 becomes fully saturated. However, because most portable toilets are not used constantly for a full 24 hours, the evaporative ingredients in the urine will have time to mostly or fully evaporate from the panels—making the urine evaporation device 100 useable again for the next day. The panel assembly can then easily be switched out when the absorbing capacity of the liquid-absorbent substance of the panels has been depleted.

By way of a third example, the urine evaporation device 100 can be part of a semi-permanent toilet. A semi-permanent toilet can be used to accommodate a large number of people (e.g., 50-100 people) on a daily basis. These semi-permanent toilets are generally much larger than a portable toilet, can include two or more urinals and toilets, and require more assembly than a portable toilet. Semi-permanent toilets are often utilized in disaster areas for both disaster victims and aid workers. According to this third example, one or more urine evaporation devices 100 can be located outside the semi-permanent toilet and connected to a urinal or toilet, for example, as described above for a portable toilet. Variations of embodiments can be used to accommodate the large number of people. The dimensions of the outer housing can be in the range of a length and height of about 3 feet (ft) (0.9 meters (m)) to about 20 ft (6.1 m) and a depth of about 1 ft (0.3 m) to about 5 ft (1.5 m). The number of panels and the dimensions of the panels can vary to correspond to the dimensions of the outer housing. Multiple devices can also be connected to the semi-permanent toilet in series or parallel.

By way of a fourth example, the urine evaporation device 100 can be for home use. For home use, the device can be permanently coupled to urinals and toilets of the home. The various embodiments of the device can be similar to a device for a portable toilet—accommodating the urine output from 1 to several people. The panel assembly 150 and the outer housing 110 can be varied to allow easy removal and insertion of new panel assemblies.

Methods of evaporating evaporative ingredients in urine include flowing urine into a fluid inlet 120/170 of the urine evaporation device 100, allowing the urine to contact the panel 151 after flowing into the fluid inlet, and causing or allowing the evaporative ingredients in the urine to evaporate. The step of causing can include removing a removable cover from the front 112 and/or back 113 of the outer housing 110 and/or turning an external fan to an "on" position to allow air flow from the fan to contact the panel(s) of the panel assembly. The methods can further include removing a first panel assembly 150 from the outer housing 110 when the absorbing capacity of the liquid-absorbent substance has been depleted. The methods can further include inserting a second panel assembly that contains panel(s) having absorbing capacity into the outer housing after removal of the first panel assembly. The methods can further include disposing of the first panel assembly or creating pieces or pellets from the panel(s) of the first panel assembly. The pieces or pellets can then be used as a fertilizer for plants, vegetables, or trees.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a–b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A urine evaporation device comprising:

an outer housing;

a panel assembly, wherein the panel assembly comprises a panel, wherein the panel assembly is contained within the outer housing, and wherein the panel comprises a liquid-absorbent substance;

a fluid inlet, wherein urine contacts the panel and is retained within the panel after flowing through the fluid inlet; and an evaporator, wherein the evaporator causes evaporative ingredients in the urine retained within the panel to evaporate.

2. The device according to claim 1, wherein the outer housing is made from a material, and wherein the material is selected from a metal, a metal alloy, hard plastics, wood, and reinforced celluloses.

3. The device according to claim 2, wherein the metal or metal of a metal alloy is selected from the group consisting of lithium, beryllium, calcium, aluminum, tin, bismuth, scandium, chromium, manganese, thorium, nickel, copper, zinc, yttrium, zirconium, praseodymium, silver, cadmium, terbium, neodymium, gadolinium, erbium, oxides of any of the foregoing, and any combinations thereof; and wherein the wood is selected from the group consisting of hickory, pecan, beech, birch, walnut, elm, sycamore, alder, aspen, oak, ash, cherry, maple, poplar, cedar, fir, hemlock, pine, redwood, spruce, and combinations thereof.

4. The device according to claim 1, wherein the dimensions of the panel are selected based on the anticipated volume of urine per day contacting the panel.

5. The device according to claim 1, wherein the panel assembly comprises two or more panels, wherein the urine is retained within at least one of the two or more panels, and wherein the two or more panels have the same or different dimensions.

6. The device according to claim 5, wherein the panel assembly further comprises one or more separators, and wherein the one or more separators separate the two or more panels.

7. The device according to claim 6, wherein the one or more separators comprise openings or are made from a porous material, and wherein the openings or pores of the porous material allow urine to flow between the two or more panels.

8. The device according to claim 1, wherein the panel assembly is permanently or removably contained within the outer housing.

9. The device according to claim 8, wherein the panel assembly further comprises sidewalls, and wherein the sidewalls facilitate permanent containment within the outer housing or facilitate insertion and removal from the outer housing.

10. The device according to claim 1, wherein the liquid-absorbent substance is a superabsorbent substance.

11. The device according to claim 10, wherein the superabsorbent substance is selected from the group consisting of a starch-based superabsorbent material, a cellulose-based superabsorbent material, a synthetic superabsorbent material, a superabsorbent polymer, and combinations thereof in any proportion.

12. The device according to claim 11, wherein the superabsorbent polymer is selected from the group consisting of cross-linked sodium polyacrylate, poly-acrylic acid sodium salt, polyacrylamide copolymer, ethylene maleic anhydride copolymer, cross-linked carboxymethylcellulose, polyvinyl alcohol copolymers, cross-linked polyethylene oxide, starch grafted copolymer of polyacrylonitrile, and combinations thereof in any proportion.

13. The device according to claim 1, wherein the liquid-absorbent substance is selected from the group consisting of cellulose and modified cellulose including cellulose fibers, cotton fibers, plant bark, wood, plant leaves, grass, paper, cardboard, and egg crates; cottonseed hulls; sawdust; wood shavings; a biomass substance; and combinations thereof.

14. The device according to claim 1, wherein the evaporator allows airflow to contact the panel of the panel assembly to evaporate the evaporative ingredients from urine.

15. The device according to claim 1, wherein the outer housing comprises the evaporator.

16. The device according to claim 15, wherein no material covers a front of the outer housing from the perimeter of the outer housing such that the front of the outer housing is open to airflow, and wherein a back of the outer housing is covered by a solid material from the perimeter of the outer housing such that the back of the outer housing is not open to airflow.

17. The device according to claim 15, wherein a front of the outer housing, a back of the outer housing, or both the front and the back of the outer housing comprise a porous material covering that overlays the panel assembly, and wherein the porous material is selected from a wire mesh screen, a hard plastic screen, or a flexible plastic screen.

18. The device according to claim 1, wherein the panel comprises one or more voids within the panel, and wherein the one or more voids work in tandem with the evaporator for increasing the evaporation rate of the evaporative ingredients in the urine.

19. A method of evaporating evaporative ingredients in urine comprising:

flowing urine into a fluid inlet of a urine evaporation device, wherein the urine evaporation device comprises:

an outer housing; and a panel assembly, wherein the panel assembly comprises a panel, wherein the panel assembly is contained within the outer housing, and wherein the panel comprises a liquid-absorbent substance;

allowing the urine to contact the panel and be retained within the panel after flowing into the fluid inlet; and causing or allowing the evaporative ingredients in the urine retained within the panel to evaporate.

20. The method according to claim 19, further comprising inserting a second panel assembly into the outer housing when the liquid-absorbent substance of the panel becomes fully saturated with urine and is no longer capable of having the evaporative ingredients in the urine evaporate, wherein the second panel assembly comprises a panel that is not fully saturated with urine.

* * * * *